US005893761A

United States Patent [19]

Longueville

[11] Patent Number: 5,893,761

[45] Date of Patent: Apr. 13, 1999

[54] PRINTED CIRCUIT BOARD CONNECTOR

[75] Inventor: Jacques Longueville, Oostkamp, Belgium

[73] Assignee: Siemens Aktiengesellschaft, Munich, Germany

[21] Appl. No.: 08/799,772

[22] Filed: Feb. 12, 1997

[30] Foreign Application Priority Data

Feb. 12, 1996 [DE] Germany ..... 196 05 099

[51] Int. Cl.[6] ..... H01R 9/09

[52] U.S. Cl. ..... 439/66; 439/608

[58] Field of Search ..... 439/66, 74, 608, 439/607

[56] References Cited

U.S. PATENT DOCUMENTS

| | | | |
|---|---|---|---|
| 4,433,886 | 2/1984 | Cassarly | 439/65 |
| 4,752,231 | 6/1988 | Olsson | 439/66 |
| 4,927,369 | 5/1990 | Grabbe et al. | 439/66 |
| 4,957,800 | 9/1990 | Grabbe | 439/74 |
| 5,167,512 | 12/1992 | Walkup | 439/66 |
| 5,215,472 | 6/1993 | DelPrete et al. | 439/66 |
| 5,237,743 | 8/1993 | Busacco et al. | 439/66 |
| 5,324,205 | 6/1994 | Ahmad et al. | 439/66 |
| 5,395,252 | 3/1995 | White | 439/66 |
| 5,484,295 | 1/1996 | Mowry et al. | 439/66 |

FOREIGN PATENT DOCUMENTS 0 651 466 5/1995 European Pat. Off. .

*Primary Examiner*—Steven L. Stephan
*Assistant Examiner*—T C Patel
*Attorney, Agent, or Firm*—Herbert L. Lerner; Laurence A. Greenberg

[57] ABSTRACT

A printed circuit board connector includes contact elements for electrically connecting contacts of at least two electrical printed circuit boards, and retaining devices retaining the contact elements in an intended position inside the printed circuit board connector. The contact elements and the retaining devices are constructed and/or disposed in such a way as to cause forces exerted upon the retaining devices by and/or through the contact elements to at least partly cancel one another out in the region of the retaining devices.

11 Claims, 2 Drawing Sheets

PRINTED CIRCUIT BOARD CONNECTOR

BACKGROUND OF THE INVENTION

FIELD OF THE INVENTION

The invention relates to a printed circuit board connector having contact elements for electrically connecting contacts of at least two electrical printed circuit boards, and having retaining devices that retain the contact elements in their intended position inside the printed circuit board connector.

Such printed circuit board connectors are known in great numbers.

The increasing complexity of printed circuit boards that are to be connected necessitates the use of printed circuit board connectors with ever higher numbers of poles. Moreover, the demands of quality are increasing as well. Such demands include, among others, demands for strength and reliability of the electrical connections that can be made by the printed circuit board connectors (high contact forces).

Printed circuit board connectors that meet those demands are being put in contact with the printed circuit boards to be connected to one another, and in a connection position of those printed circuit boards a not inconsiderable force, which necessitates a correspondingly stable construction of those elements, is exerted upon the retaining devices that keep the contact elements in their intended position within the printed circuit board connector, on the printed circuit board connector housing, and on the connections between the retaining devices and the contact elements as well as between the retaining devices and the printed circuit board connector housing.

However, an especially stable construction of those elements results in an increase in their size and is thus contrary to the further demand that the printed circuit board connectors be kept as small as possible or be made with the highest possible contact element density.

SUMMARY OF THE INVENTION

It is accordingly an object of the invention to provide a printed circuit board connector, which overcomes the hereinafore-mentioned disadvantages of the heretofore-known devices of this general type in such a way that it can also be made small and/or with a high contact element density, even in a high polarity version and/or in an embodiment used to attain especially high contact forces.

With the foregoing and other objects in view there is provided, in accordance with the invention, a printed circuit board connector, comprising contact elements for electrically connecting contacts of at least two electrical printed circuit boards; and retaining devices retaining the contact elements in an intended position inside the printed circuit board connector; the contact elements and the retaining devices being constructed and/or disposed for causing forces exerted upon the retaining devices by and/or through the contact elements to at least partly cancel one another out in the region of the retaining devices.

The provision of a partial cancellation of the forces on the retaining devices (for instance through the use of an at least partly symmetrical construction of the contact elements relative to the retaining devices) has the direct consequence of causing the resultant forces in the region of the retaining devices to be considerably lower, so that the stability and therefore the size of the retaining devices, the printed circuit board connector housing, and the connections between the retaining devices and the contact elements and between the retaining devices and the printed circuit board connector housing, can be reduced markedly.

Accordingly, a printed circuit board connector has been created that even in a high polarity version and/or in an embodiment for attaining especially high contact forces, can be made small and/or with high contact element density.

In accordance with another feature of the invention, the contact elements electrically connect parallel printed circuit boards. In accordance with a further feature of the invention, the contacts of the electrical printed circuit boards are surface contacts.

In accordance with an added feature of the invention, there are provided conduits inside the printed circuit board connector, the contact elements being passed through the conduits and having end portions pressed elastically back into the conduits in a connection position of the printed circuit board connector. In accordance with an additional feature of the invention, the conduits and the contact elements have a curved course. In accordance with yet another feature of the invention, the retaining devices fix the contact elements inside the conduits for securing the contact elements against displacement along the conduits.

In accordance with yet a further feature of the invention, there is provided a screw connection for securing the printed circuit board connector and the printed circuit boards to one another.

In accordance with yet an added feature of the invention, there is provided a housing having a plurality of individual parts to be guided along one another when put together to permit a force-free introduction of the contact elements into the conduits. In accordance with yet an additional feature of the invention, there is provided a mounting frame for holding the individual parts together. In accordance with again another feature of the invention, the mounting frame enables an electrical connection of the housing to ground contacts on the printed circuit boards, in a connection position of the printed circuit board connector. In accordance with a concomitant feature of the invention, the housing is electrically conductive.

Other features which are considered as characteristic for the invention are set forth in the appended claims.

Although the invention is illustrated and described herein as embodied in a printed circuit board connector, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
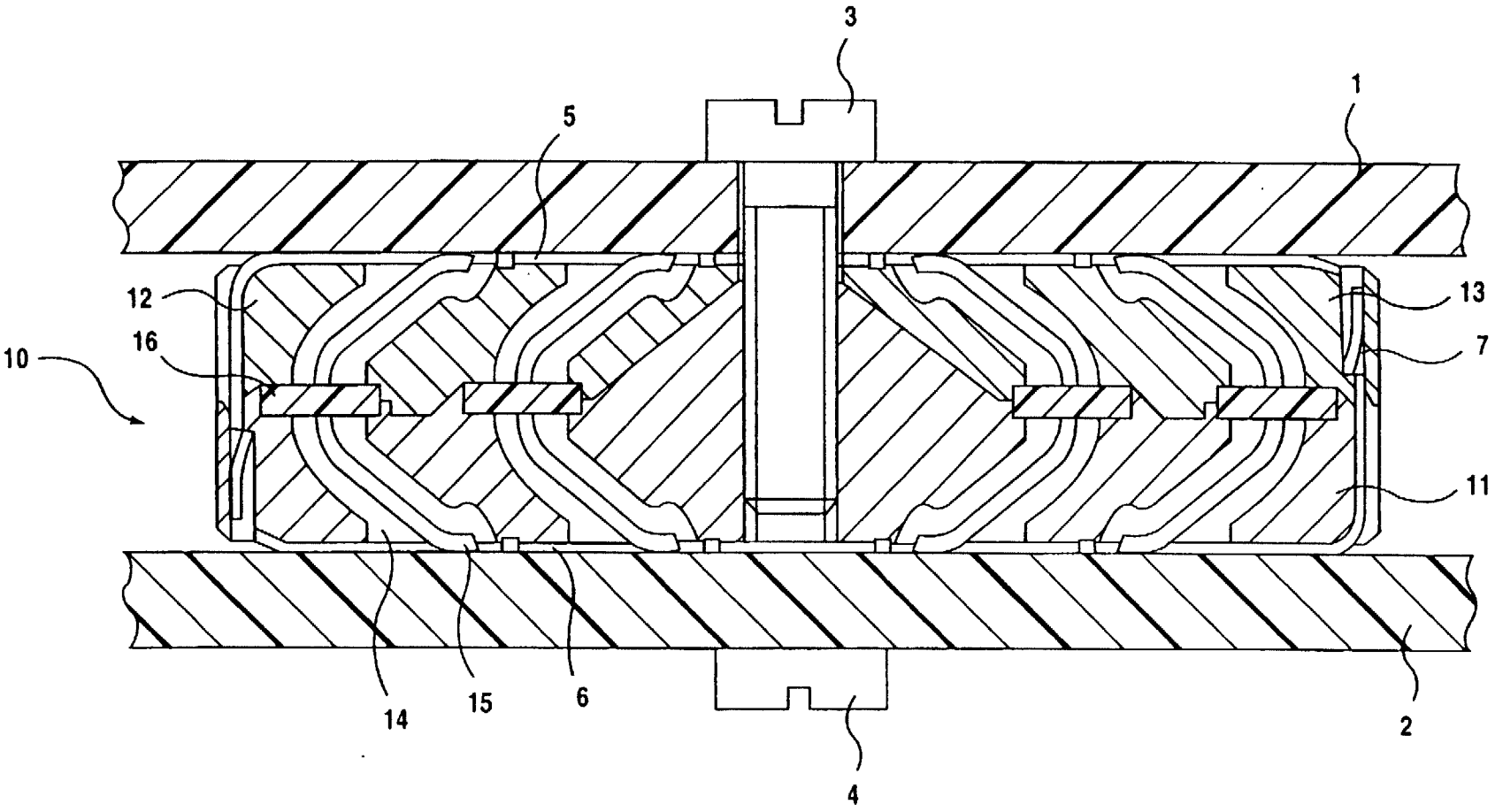
FIG. 1 is a fragmentary, diagrammatic, sectional view of a printed circuit board connector connecting two printed circuit boards, according to a first exemplary embodiment of the invention.

Referring now to the figures of the drawings in detail and first, particularly, to FIG. 1 thereof, there is seen a printed circuit board connector which represents a printed circuit board connector according to an exemplary embodiment of the present invention and is identified by reference numeral 10. In a connection position shown in FIG. 1, the printed circuit board connector 10 is disposed (clamped) between first and second parallel printed circuit boards 1 and 2, and it is held in this position through the use of screws 3 and 4. The printed circuit boards 1 and 2 are respectively shown as upper and lower printed circuit boards in FIG. 1. A first contact strip element 5 is provided between the printed circuit board connector 10 and the first printed circuit board 1, and a second contact strip element 6 is provided between the printed circuit board connector 10 and the second printed circuit board 2.

A housing of the printed circuit board connector 10 includes a lower part 11 and two upper parts 12 and 13 seen in FIG. 1. The housing, or the components forming the housing, are electrically conductively constructed, or in other words are preferably made of metal or a material that contains metal.

Conduits 14 are formed inside the housing of the printed circuit board connector 10. The conduits have a curved course as shown in FIG. 1. In the connection position shown in FIG. 1, the conduits extend substantially continuously from a surface of the first printed circuit board 1 to a surface of the second printed circuit board 2.

An elongated contact element 15 is extended inside each conduit 14 and spaced apart from the conduit walls. The elongated contact element 15 can electrically connect a contact spot (surface contact) provided on the surface of the first printed circuit board 1 to a contact spot (surface contact) provided on the surface of the second printed circuit board 2. The contact elements 15 are constructed to be elastically bendable, at least on their ends.

As long as the printed circuit board connector is not in the connection position shown in FIG. 1, outer ends of the contact elements 15 protrude out of the conduits 14 at both sides of the conduits. When the printed circuit board connector is moved into the connection position shown in FIG. 1, end portions of the contact elements 15 are pressed backward into the respective conduits, in the process of the clamping of the printed circuit board connector between the first and second electrical printed circuit boards. In the connection position of the printed circuit board connector, the end portions of the contact elements exert a contact pressure force on the contact spots to be contacted on the surfaces of the printed circuit boards, and as a result they assure high contact forces, or in other words a strong and reliable printed circuit board connection, from the surface of one printed circuit board to another.

The electrical connection of the printed circuit boards solely through surface contacts aids in reducing reflection from the connection points and thereby enables a considerable lessening of signal distortion, since there is no or at least no significant overlap in the current flow direction of the elements that effect the electrical connection. Moreover, it enables a simpler, more-stable construction of the printed circuit boards in the connection region (without any connection holes for press-fitting an electrical connector into the printed circuit board).

In the connection position of the printed circuit board connector, the contact elements 15 are substantially surrounded entirely, over their entire length, by the walls of the conduits 14.

Approximately in the middle between the ends of the conduits (at a boundary between the lower part 11 and the upper parts 12 and 13 of the housing of the printed circuit board connector), each of the contact elements 15 are retained by a retaining element 16. The retaining elements 16 are each solidly connected to the respective contact elements 15. The retaining elements 16 have dimensions that exceed the internal dimensions of the respective conduits 14. They are inserted into suitable recesses between the lower part 11 and the upper parts 12, 13 of the printed circuit board connector housing, in such a way that in the assembled state of the printed circuit board connector they are immovably connected to the connector.

The retaining elements 16 (partly in cooperation with the contact elements 15 retained by them) have multiple functions: First of all, they are intended to prevent the contact elements 15 from touching the electrically conductive conduit walls. Moreover, they are intended to prevent the contact elements from being displaceable along the various conduits. Finally, however, they are also intended to enable a defined motion of the contact elements inside the conduits (for instance, a motion parallel to a conduit wall that defines the impedance, especially when the printed circuit board connector is put into its connection position) and to preclude other motions, for instance by a suitable cross-sectional construction or the like, above all of the contact elements.

The contact elements 15 are disposed substantially symmetrically with respect to the retaining elements 16, at least in their immediate vicinity, or are disposed in such a way that the forces exerted on the retaining elements 16 by or through the contact elements 15 have a substantially symmetrical course with respect to the retaining elements, at least in their immediate vicinity. It is possible as a result for the forces exerted on the retaining elements 16 by or through the contact elements 15 to cancel one another out at least partially in the region of the retaining elements 16. The retaining elements 16 themselves, along with the printed circuit board connector housing, the connection between the retaining elements and the contact elements, and in particular the anchoring of the retaining elements in the printed circuit board connector housing, as a result may have only a relatively slight stability and be correspondingly small, without problems. The printed circuit board connector according to the invention can therefore be constructed to be relatively small and/or can have a very high contact density (given a close-together configuration of the contact elements or rows of contact elements, optionally with interesting thereof).

The contact strip elements 5, 6, as already noted above, are provided between the printed circuit board connector and the electrical printed circuit boards. These contact strip elements are electrically conductively constructed and serve to make an electrical connection between ground contacts of the printed circuit boards to be connected to one another.

However, no separate contact elements 15 are provided in the present exemplary embodiment for connecting the ground contacts. Instead, the electrical connection between the ground contacts of the various electrical printed circuit boards is accomplished by a different kind of establishment of a continuous electrical connection path. The connection path namely extends from the ground contacts of the first printed circuit board 1 through the associated first (electrically conductive) contact strip element 5, the (electrically conductive) housing of the printed circuit board connector, and the second (electrically conductive) contact strip element 6, assigned to the second electrical printed circuit board 2, to the ground contacts of the second electrical printed circuit board 2.

This kind of ground connection has various kinds of advantages. On one hand, the number of contact elements 15 to be provided in the printed circuit board connector can be reduced quite considerably under some circumstances as a result, and on the other hand, the grounding of the housing of the printed circuit board connector has the positive effect of ensuring that the contact elements 15, extending entirely inside the conduits 14, are perfectly shielded from one another over their entire length, thus reducing the danger of crosstalk or other mutual influences to a minimum.

In order to enable an assurance between perfect contact-making between the ground contacts of the printed circuit boards and the housing of the printed circuit board connector, the contact strip elements 5, 6 have resilient contact laminations at the top and bottom. The contact strip elements have corresponding recesses at those locations where contact spots of the printed circuit boards are to be connected to the contact elements 15 of the printed circuit board connector. However, many ground contacts for which contact can be made by the contact strip elements may be provided, particularly in the immediate vicinity of such recesses, that is around the conduit openings.

Figure 2A:
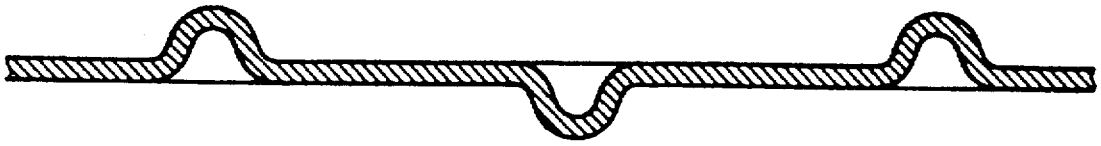
FIG. 2*a* is a fragmentary, sectional view of an exemplary embodiment of a contact strip element in an uncontacted state.
Figure 2B:
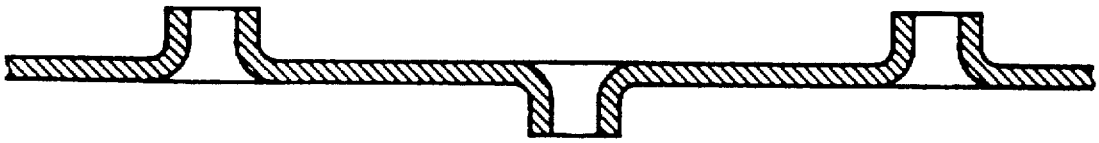
FIG. 2*b* is a fragmentary, sectional view of a further exemplary embodiment of a contact strip element in the uncontacted state.
Figure 2C:
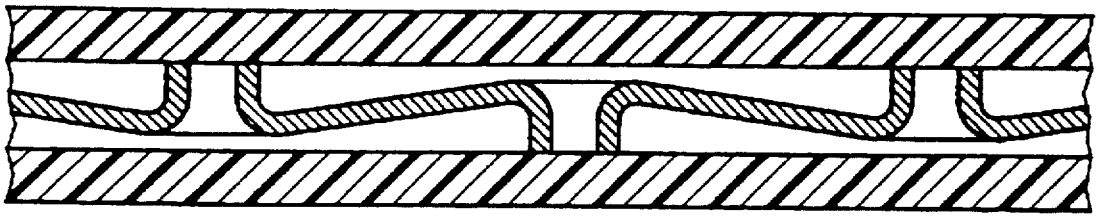
FIG. 2*c* is a fragmentary, sectional view of the contact strip element shown in FIG. 2*b*, in a state in which it is clamped between two surfaces to be connected electrically to one another.

Two of the possible embodiments of such contact strip elements are shown in FIGS. 2*a* and 2*b*. In order to illustrate the mode of operation of such contact strip elements, the contact strip element shown in FIG. 2*b* is shown in FIG. 2*c* in a state in which it is fastened between two surfaces to be electrically connected to one another.

The aforementioned contact strip elements 5, 6 are components of a two-part mounting frame that is capable of receiving the printed circuit board connector inside it. More specifically, the first contact strip element forms a top side of a half-shell-shaped first half of the mounting frame, and the second contact strip element forms a bottom side of a half-shell-shaped second half of the mounting frame. Each of the contact strip elements moreover have extensions that form side elements of the halves of the mounting frame but that no longer need to have a structure of the kind shown in FIGS. 2*a* and 2*b* and instead can be structured arbitrarily differently.

Spring tabs 7 are provided on the side parts of the respective halves of the mounting frame and can lock in detent fashion in corresponding recesses in the housing of the printed circuit board connector. As is shown in FIG. 1, the lower half of the mounting frame, in terms of FIG. 1, can lock in detent fashion to the top parts 12, 13 of the printed circuit board connector housing, and the half of the mounting frame at the top in FIG. 1 can lock in detent fashion to the lower part 11 of the printed circuit board connector housing.

The multi-part construction of the printed circuit board connector housing, which is shown in FIG. 1, serves to make it simple to put the connector together: First, the contact elements 15, with the retaining elements 16 secured to them, are inserted into the lower part 11 of the printed circuit board connector housing or more precisely into the conduit parts provided in that portion. They are introduced in such a way that the retaining elements 16 come to rest in corresponding recesses on the top of the lower part 11 of the printed circuit board connector housing. Once all of the conduits 14 have been equipped with contact elements 15, the two upper parts 12, 13 of the printed circuit board connector housing are placed on the lower part, with these elements initially merely resting loosely on one another.

The placement of the upper parts on the lower part is carried out by an obliquely extending placement motion. More specifically, the upper part 12 on the left in the drawing is put in place through the use of a movement from the upper right to the lower left, and the upper part 13 on the right in the drawing is put in place through the use of a movement from the top left to the bottom right. The extent of the oblique motion depends on the shape of the contact elements. In the ideal case, slipping the upper parts over the upper half of the contact elements, that is the upper half in terms of the drawing, is carried out in such a way that the contact elements do not touch the conduit walls at all, or at most only slightly, or in other words are substantially parallel to the course of the contact elements in the region to be covered. In this way, damage to the conduit walls and/or the contact elements during mounting can be maximally avoided. Another favorable factor is that not only all of the contact elements onto which the upper left part 12 in the drawing is placed but also all of the contact elements onto which the upper right part 13 in the drawing is placed, extend parallel to one another. The contact elements belonging to different groups (to be covered by different upper parts) are not constructed in the present exemplary embodiment as parallel but rather symmetrical to one another, for the sake of attaining a symmetrical distribution of force with respect to the connection of the electrical connector to the printed circuit board to be connected, as will be described below.

In order to make quite certain of the aforementioned oblique placement motion, the lower part has a protrusion of the kind shown in the drawing, with two inclines facing one another, along which the upper parts can be guided (can slide downward) as they are placed on the lower part. The inclines that are clearly visible in the drawing have a course which is essentially parallel to the course of the contact element portions that are each to be covered by the associated upper parts. However, the inclines need not extend straight as shown in the drawing, but instead (preferably with close reliance on the shape of the contact elements) may also have any arbitrary other shape (for instance being stairstep-like or curved).

In order to attain an even more precisely defined guidance of the upper parts on the guide inclines of the lower part, and therefore an even more-perfect guidance of the contact elements inside the conduits when the upper parts are placed on the lower part, or more specifically to also prevent a lateral offset of the upper parts and lower parts when they are placed one another the other, the guide inclines may be provided with guide elements, for instance in the form of rails or grooves, that extend straight or obliquely or curved on their surface, and which can be engaged by suitable complementary elements of the upper parts.

The above-described embodiment of the components of a multiple-part electrical connector can be usefully employed not only in the type of printed circuit board connector described herein but also quite generally in any kind of electrical connector. Such an embodiment reliably makes it possible to put together connector components simply and without force while at the same time securing the contact elements of the electrical connector.

The upper parts and lower part are held together through the use of the detent locking of the configuration having the mounting frame halves, already was explained above.

In the state in which engagement with the mounting frame has been brought about, the printed circuit board connector is prepared for making a connection with printed circuit boards that are to be connected to one another.

The connection is made by fasteners, such as the screws 3, 4, of which a plurality are disposed in line with one another in the view of FIG. 1 and which enter alternatingly from above and from below.

The alternating fastening of opposed sides of the configuration makes it possible to provide a high density of fasteners, which in turn makes it possible for even small printed circuit board connectors to be reliably firmly connected to the printed circuit boards that are to be connected to one another.

The connection of the elements by screws can be achieved in the most various ways (screwing into the printed circuit board connector housing, screwing with nuts, screwing a plurality of screw elements in one another in interested fashion, and so forth).

Regardless of the type of fastener, it proves to be advantageous if the printed circuit board connector is clamped as uniformly strongly as possible between the printed circuit boards to be joined together, with the additional interposition of the contact strip elements, because in this way on one hand uniformly good connections are obtained, and on the other hand the resultant distribution of force to the contact elements leads to an improved force compensation in the region of the retaining elements 16.

It may also be worthwhile to construct or select the printed circuit board connector and the fastener, or to define the use of these elements, in such a way that the connection between the printed circuit board connector and the first printed circuit board and the connection between the printed circuit board connector and the second printed circuit board, are made simultaneously and each to the identical extent. As a result, the aforementioned force compensation can already be realized as the printed circuit board connector is introduced into its connecting position as well as when the printed circuit board connector is released from this position.

The present description has related to a printed circuit board connector for transmitting asymmetrical signals (one internal conductor and one common outer conductor each). The printed circuit board connector described herein, optionally with suitable modification, can also be used for transmitting symmetrical signals (two internal conductors).

In the case where asymmetrical signals are transmitted, that is, if only one internal conductor is provided, an impedance of the printed circuit board connector is settable by setting (and maintaining) a spacing between the internal conductor and an impedance-determining side wall of the conduit.

In the event that symmetrical signals are transmitted, that is, if two internal conductors are provided, an impedance of the printed circuit board connector can be adjusted by setting (and maintaining) a spacing between the two (internal) conductors and by setting a spacing between the two internal conductors and an impedance-determining side wall of the conduit.

In order to ensure that an impedance value once set will be kept constant under all circumstances, the conduits 14, contact elements 15 and retaining elements 16 should be constructed in such a way that the elastic motion of the contact elements 15 inside the conduits 14 that takes place when the printed circuit board connector is introduced into and/or released from its connecting position, is possible solely in directions which do not cause any change in impedance (an example being a motion parallel to an impedance-determining wall).

I claim:

1. A printed circuit board connector, comprising:

a housing including an upper part and a lower part, said housing having conduits with a recess; contact elements for electrically connecting contacts of at least two electrical printed circuit boards; and retaining devices retaining said contact elements in said conduits, one of said retaining devices provided for each one of said contact elements and solidly connected thereto, each one of said retaining devices fixedly inserted within a respective recess of one of said conduits and retaining a respective one of said contact elements in a respective conduit;

said contact elements and said retaining devices causing forces exerted upon said retaining devices due to said contact elements to at least partly cancel one another out in vicinity of said retaining devices.

2. The printed circuit board connector according to claim 1, wherein said contact elements electrically connect parallel printed circuit boards.

3. The printed circuit board connector according to claim 1, wherein the contacts of the electrical printed circuit boards are surface contacts.

4. The printed circuit board connector according to claim 1, including conduits inside the printed circuit board connector, said contact elements being passed through said conduits and having end portions pressed elastically back into said conduits in a connection position of the printed circuit board connector.

5. The printed circuit board connector according to claim 4, wherein said conduits and said contact elements have a curved course.

6. The printed circuit board connector according to claim 4, wherein said retaining devices fix said contact elements inside said conduits for securing said contact elements against displacement along said conduits.

7. The printed circuit board connector according to claim 1, including a screw connection for securing the printed circuit board connector and the printed circuit boards to one another.

8. The printed circuit board connector according to claim 4, including a housing having a plurality of individual parts to be guided along one another when put together to permit a force-free introduction of said contact elements into said conduits.

9. The printed circuit board connector according to claim 8, including a mounting frame for holding said individual parts together.

10. The printed circuit board connector according to claim 9, wherein said mounting frame enables an electrical connection of said housing to ground contacts on the printed circuit boards, in a connection position of the printed circuit board connector.

11. The printed circuit board connector according to claim 8, wherein said housing is electrically conductive.

* * * * *